United States Patent [19]

Nakaniwa et al.

[11] Patent Number: 4,941,448

[45] Date of Patent: Jul. 17, 1990

[54] FUEL SUPPLY CONTROL SYSTEM FOR INTERNAL COMBUSTION ENGINE WITH IMPROVED RESPONSE CHARACTERISTICS TO VARIATION OF INDUCTION AIR PRESSURE

[75] Inventors: Shinpei Nakaniwa; Naoki Tomisawa, both of Gunma, Japan

[73] Assignee: Japan Electronic Control Systems Co., Ltd., Isczaki, Japan

[21] Appl. No.: 247,470

[22] Filed: Sep. 21, 1988

[30] Foreign Application Priority Data

Sep. 22, 1987 [JP] Japan ..... 62-236299

[51] Int. Cl.[5] ..... F02D 41/32

[52] U.S. Cl. ..... 123/488; 123/480; 123/489

[58] Field of Search ..... 123/478, 480, 486, 488, 123/494, 489

[56] References Cited

U.S. PATENT DOCUMENTS

| | | | |
|---|---|---|---|
| 4,112,879 | 9/1978 | Assenheimer et al. | 123/478 |
| 4,404,946 | 9/1983 | Hoard et al. | 123/478 |
| 4,671,242 | 6/1987 | Akiyama et al. | 123/486 |

*Primary Examiner*—Andrew M. Dolinar

*Attorney, Agent, or Firm*—Foley & Lardner, Schwartz, Jeffery, Schwaab, Mack, Blumenthal & Evans

[57] ABSTRACT

A fuel supply control system derives a basic induction volume efficiency on the basis of an intake air pressure and modifies the basic induction volume efficiency with a correction value which is derived on the basis of an engine revolution speed and the intake air pressure. An induction volume efficiency is derived on the basis of modified basic induction volume efficiency, which derived induction volume efficiency is used for deriving a basic fuel supply amount with the intake air pressure. The basic fuel supply amount thus derived is used for controlling fuel supply for the engine. Derivation of the basic induction volume efficiency is performed by an interrupt routine which may be executed in a predetermined timing derived depending upon a time or in synchronism with engine revolution cycle. The correction value may be derived in a background job. Since the variation range of the corrective value is relatively small versus variation of the basic induction volume efficiency, smaller capacity of memory is required even when the correction value is set in a form of a two-dimensional table. With this, the memory capacity required for setting the two-dimensional map can be small but can provide satisfactorily high precision in controlling air/fuel ratio.

14 Claims, 12 Drawing Sheets

11
ROM
DB
110
NVO
115
KTA
116
PBD
117
KFLAT
125
KALT
129
103
CPC
FL FEEDBACK
119
101
FL LEAN
120
FL RICH
124
FL INV
122
FL ABNORMAL
123
FLACC
112
TACC
113
FALT
114
ALT
128
C
121
RAM
TVO
118
Kλ
KLRN
126
ALTo
127
102
104
INTERFACE
A/D
105
N
106
Ti
107
Ta
TVO
SIDL
VPB
Tw
O2
θ ref
θ pos
VSP
NT
SCINJ
SCIDL
INTAKE AIR TEMP.
THROTTLE ANGLE
IDLING
INTAKE AIR PRES.
COOLANT TEMP.
O2
CRANK ANGLE
VEHICLE SPEED
NEUTRAL
INJECTION
IDLING SPEED
7
8
84
9
12
14
15
16
17
18
19

FUEL SUPPLY CONTROL SYSTEM FOR INTERNAL COMBUSTION ENGINE WITH IMPROVED RESPONSE CHARACTERISTICS TO VARIATION OF INDUCTION AIR PRESSURE

BACKGROUND OF THE INVENTION

1. Field of the Invention

The present invention relates generally to a fuel supply control system for an internal combustion engine of an automotive vehicle. More specifically, the invention relates to a fuel supply control system which controls fuel delivery amount on the basis of an intake air pressure and an engine revolution speed. Further particularly, the invention relates to a fuel supply control which can perform precise and high response fuel delivery control with minimum memory capacity.

2. Description of the Background Art

In one of typical fuel supply control system, an intake air pressure and an engine revolution speed are taken as basic parameter for deriving a basic fuel supply amount. Usually, the basic fuel supply amount is derived by table look-up against a two-dimensional table in terms of the intake air pressure and the engine revolution speed. However, derivation of basic fuel supply amount requires more complex process because mixture volume efficiency which is efficiency in packing of air/fuel mixture into a combustion chamber. Furthermore, in order to obtain satisfactory precision in fuel supply amount control, relative large two-dimensional look-up table becomes necessary. This requires not only higher cost but also longer process time to cause lag in acceleration and deceleration to lower fuel control performance.

Because of long process period required in setting the basic fuel supply amount, table look-up operation is generally done in a background job. In such case, updating of the basic fuel supply amount versus the intake air pressure and the engine revolution speed cannot be updated frequent enough to maintain an air/fuel ratio in the vicinity of stoichiometric value in an engine driving condition which requires frequent interruption of the background job.

For improving the drawback in the conventional art set forth above, Japanese Patent First (unexamined) Publications (Tokkai) Showa 58-41230 and Showa 59-32634 propose use of one-dimensional maps which are separately set for separately looking up in terms of the intake air pressure and the engine revolution speed for deriving induction volume efficiency. The induction volume efficiency derived in terms of the intake air pressure is multiplied with that derived in terms of the engine speed. In the alternative approach, both two-dimensional map and one-dimensional maps are used so that the induction volume efficiency is derived utilizing the two-dimensional map while the engine is in low speed range and is derived utilizing the one-dimensional maps while the engine is in high speed range. However, in either case, the precision level in air/fuel ratio control cannot be satisfactorily high.

SUMMARY OF THE INVENTION

Therefore, it is an object of the invention to improve the defect in the background art and to provide a fuel supply control system which can achieve both of high process speed with reduced necessary memory capacity and high precision in air/fuel ratio control.

In order to accomplish aforementioned and other objects, a fuel supply control system, according to the present invention, derives a basic induction volume efficiency on the basis of an intake air pressure and modifies the basic induction volume efficiency with a correction value which is derived on the basis of an engine revolution speed and the intake air pressure. An induction volume efficiency is derived on the basis of modified basic induction volume efficiency, which derived induction volume efficiency is used for deriving a basic fuel supply amount with the intake air pressure. The basic fuel supply amount thus derived is used for controlling fuel supply for the engine.

In the preferred process, derivation of the basic induction volume efficiency is performed by an interrupt routine which may be executed in a predetermined timing derived depending upon a time or in synchronism with engine revolution cycle. The correction value may be derived in a background job. Since the variation range of the correction value is relatively small versus variation of the basic induction volume efficiency, smaller capacity of memory is required even when the correction value is set in a form of a two-dimensional table. With this, the memory capacity required for setting the two-dimensional map can be small but can provide satisfactorily high precision in controlling air/fuel ratio.

According to one aspect of the invention, a fuel supply control system for an internal combustion engine, comprises:

means for supplying a controlled amount of fuel to an induction system of the internal combustion engine;

means for monitoring an engine driving condition including an engine speed and an intake air pressure;

means for deriving a basic volumetric efficiency on the basis of one of the engine speed and the intake air pressure;

means for deriving a correction value for the basic volumetric efficiency on the basis of the engine speed and the intake air pressure and modifying the basic volumetric efficiency with the correction value to derive a modified volumetric efficiency;.

means for deriving a fuel supply amount on the basis of fuel supply control parameters monitored by the monitoring means and including the intake air pressure and the modified volumetric efficiency; and means for controlling the supplying means for adjusting amount of fuel to be supplied to the induction system to the derived value.

According to another aspect of the invention, a fuel supply control system for an internal combustion engine, comprises:

fuel supply means for supplying a controlled amount of fuel to an induction system of the internal combustion engine;

monitoring means for monitoring an engine driving condition including an engine speed and an intake air pressure;

first means for deriving a first value representative of a basic volumetric efficiency on the basis the intake air pressure, the first means operating at a first frequency;

second means for deriving a correction value for the first value on the basis of the engine speed and the intake air pressure and modifying the first value with the correction value to derive a second value, the second means operating at a second frequency lower than the first frequency;

third means for deriving a basic fuel supply amount on the basis of the intake air pressure and the second value;

fourth means for deriving a correction value for the basic fuel supply amount on the basis of a correction parameter monitored by the monitoring means for deriving a control valve for controlling the supply means; and fifth means for controlling the supply means for adjusting amount of fuel to be supplied to the induction system to the derived value.

The fuel supply control system further comprises means for assuming an altitude on the basis of preselected engine driving condition indicative parameter monitored by the monitoring means.

The altitude assuming means assumes the altitude on the basis of an engine speed dependent reference pressure and an actual intake air pressure measured by the monitoring means. The fuel supply control system further comprises means for deriving a correction value of the basis of assumed altitude for correcting the fuel supply amount. The monitoring means further monitors an intake air temperature, and which further comprise means for deriving a correction value on the basis of the intake air temperature for correcting the fuel supply amount. The monitoring means further monitors an oxygen concentration in an exhaust gas, and which system further comprises means for deriving a correction value on the basis of oxygen concentration so that the oxygen concentration in the exhaust gas is maintained in the vicinity of a predetermined value corresponding to a stoichometric value of an air/fuel ratio.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
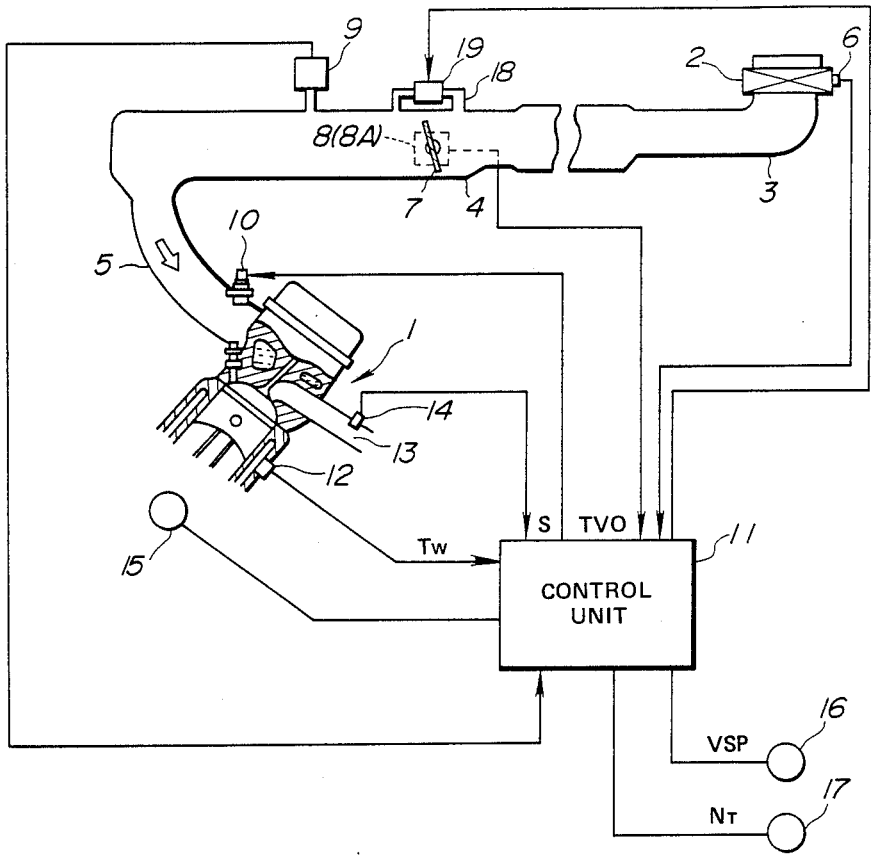
FIG. 1 is a schematic block diagram showing the preferred embodiment of a fuel supply control system according to the present invention.
Figure 2:
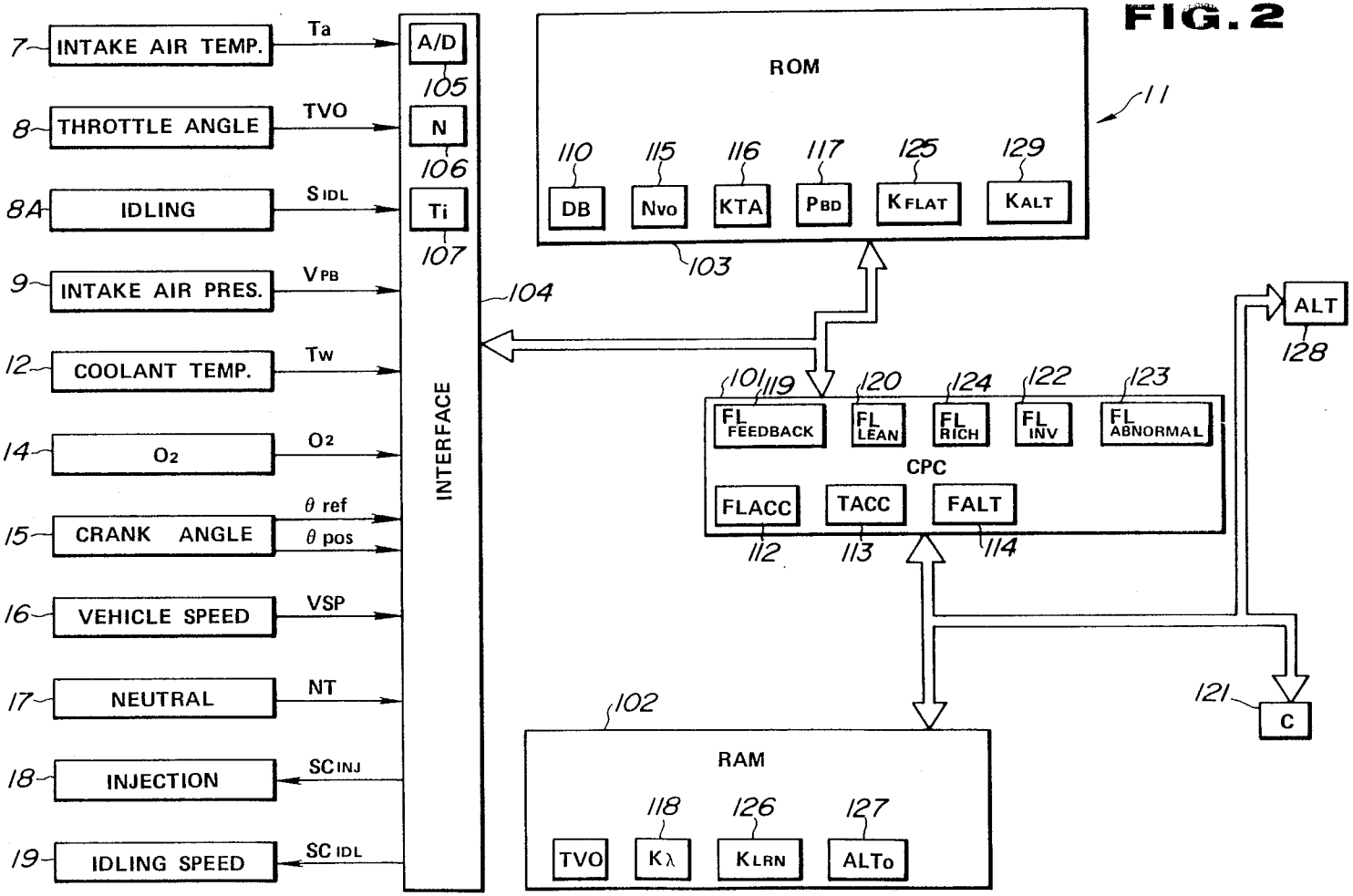
FIG. 2 is a block diagram showing detail a control unit of the preferred embodiment of the fuel supply control system of FIG. 1.

Referring now to the drawings, particularly to FIG. 1, the preferred embodiment of a fuel supply control system, according to the present invention, will be discussed in terms of fuel supply control for a fuel injection internal combustion engine. The fuel injection internal combustion engine 1 has an air induction system including an air cleaner 2, an induction tube 3, a throttle chamber 4 and an intake manifold 5. An intake air temperature sensor 6 is provided in the air cleaner 2 for monitoring temperature of an intake air to produce an intake air temperature indicative signal.

A throttle valve 7 is pivotably disposed within the throttle chamber 4 to adjust an intake air path area according to depression magnitude of an accelerator pedal (not shown). A throttle angle sensor 8 is associated with the throttle valve 7 to monitor the throttle valve angular position to produce a throttle angle indicative signal TVO. The throttle angle sensor 8 incorporates an idling switch 8A which is designed to detect the throttle valve angular position in substantially closed position. In practice, the idling switch 8A is held OFF while throttle valve open angle is greater than a predetermined engine idling criterion and ON while the throttle valve open angle is smaller than or equal to the engine idling criterion. An intake air pressure sensor 9 is provided in the induction tube 3 at the orientation downstream of the throttle valve 7 for monitoring the pressure of the intake air flow through the throttle valve 7 for producing an intake air pressure indicative signal.

In the shown embodiment, a plurality of fuel injection valves (only one is shown) 10 are provided in respective branch paths in the intake manifold 5 for injecting the controlled amount of fuel for respectively associated engine cylinder. Each fuel injection valve 10 is connected to a control unit 11 which comprises a microprocessor. The control unit 11 feeds a fuel injection pulse for each fuel injection valve 10 at a controlled timing in synchronism with the engine revolution cycle to perform fuel injection.

The control unit 11 is also connected to an engine coolant temperature sensor 12 which is inserted into an engine coolant chamber of an engine block to monitor temperature of the engine coolant and produces an engine coolant temperature indicative signal Tw. The control unit 11 is further connected to an oxygen sensor 14 disposed within an exhaust passage 13 of the engine. The oxygen sensor 14 monitors oxygen concentration contained in an exhaust gas flowing through the exhaust passage 13 to produce an oxygen concentration indicative signal. The control unit is additionally connected to a crank angle sensor 15, a vehicle speed sensor 16 and a transmission neutral switch 17. The crank angle sensor 15 monitors angular position of a crank shaft and thus monitors angular position of engine revolution cycle to produce a crank reference signal $\theta_{ref}$ at every predetermined angular position, e.g. at every crankshaft angular position 70° before top-dead center (BTDC), and a crank position signal at every predetermined angle, e.g. 1° of engine revolution. The transmission neutral switch 17 detects setting of neutral position of a power transmission (not shown) to output transmission neutral position indicative HIGH level signal $N_T$.

Furthermore, the control unit 11 receives the intake air temperature indicative signal from the intake air temperature sensor 6 and throttle angular position indicative signal of the throttle angle sensor 8, the idling switch 8A and the intake air pressure sensor 9.

In the shown embodiment, an auxiliary air passage 18 is provided to the air induction system and by-passes the throttle valve 7 for supplying an auxiliary air. An idling speed adjusting auxiliary air flow control valve 19 is provided in the auxiliary air passage 18. The auxiliary air flow control valve 19 is further connected to the control unit 11 to receive an idling speed control signal which is a pulse train having ON period and OFF period variable depending upon the engine driving condition for adjusting duty ratio of open period of the auxiliary air control valve 11. Therefore, by the idling speed control signal, the engine revolution speed during idling control signal, the engine idling speed can be controlled.

Generally, the control unit 11 comprises CPU 101, RAM 102, ROM 103 and input/output interface 104. The input/output interface 104 has an analog-to-digital (A/D) converter 105, an engine speed counter 106 and a fuel injection signal output circuit 107. The A/D converter 105 is provided for converting analog form input signals such as the intake air temperature indicative signal Ta from the intake air temperature sensor 6, the engine coolant temperature indicative signal Tw of the engine coolant temperature sensor 12, the oxygen concentration indicative signal $O_2$, a vehicle speed indicative signal VSP of the vehicle speed sensor 16 and so forth. The engine speed counter 106 counts clock pulse for measuring interval of occurrences of the crank reference signal $\theta_{ref}$ to derive an engine speed data N on the basis of the reciprocal of the measured period. The fuel injection signal output circuit 107 includes a temporary register to which a fuel injection pulse width for respective fuel injection valve 10 is set and outputs drive signal for the fuel injection signal at a controlled timing which is derived on the basis of the set fuel injection pulse width and predetermined intake valve open timing.

Detail of the discrete form construction of the control unit will be discussed from time to time with the preferred process of the fuel injection control to be executed by the control unit, which process will be discussed herebelow with reference to FIGS. 3 to 13.

Figure 3:
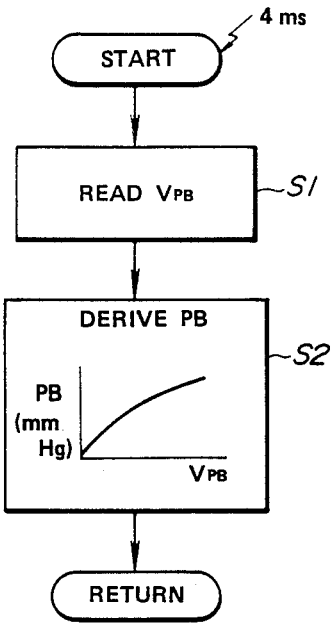
FIG. 3 a flowchart of a routine for deriving a intake air pressure on the basis of an intake pressure indicative signal of a intake air pressure sensor.

FIG. 3 shows a routine for deriving an intake air pressure data $P_B$ on the basis of the intake air pressure indicative signal $V_{PB}$ which is originally voltage signal variable of the voltage depending upon the magnitude of the intake air pressure. The shown routine of FIG. 3 is triggered and executed every 4 ms by interrupting a background job which may include a routine for governing trigger timing of various interrupt routines, some of which will be discussed later.

Immediately after starting execution of the routine of FIG. 3, the intake air pressure indicative signal $V_{PB}$ is read out at a step S1. Then, a intake air pressure map 110 which is set in ROM 103 in a form of one-dimensional map, is accessed at a step S2. At the step S2, map look-up is performed in terms of the read intake air pressure indicative signal $V_{PB}$ to derive the intake air pressure data PB. After deriving the intake pressure data PB (mmHg), process returns to the background job.

Figure 4A:
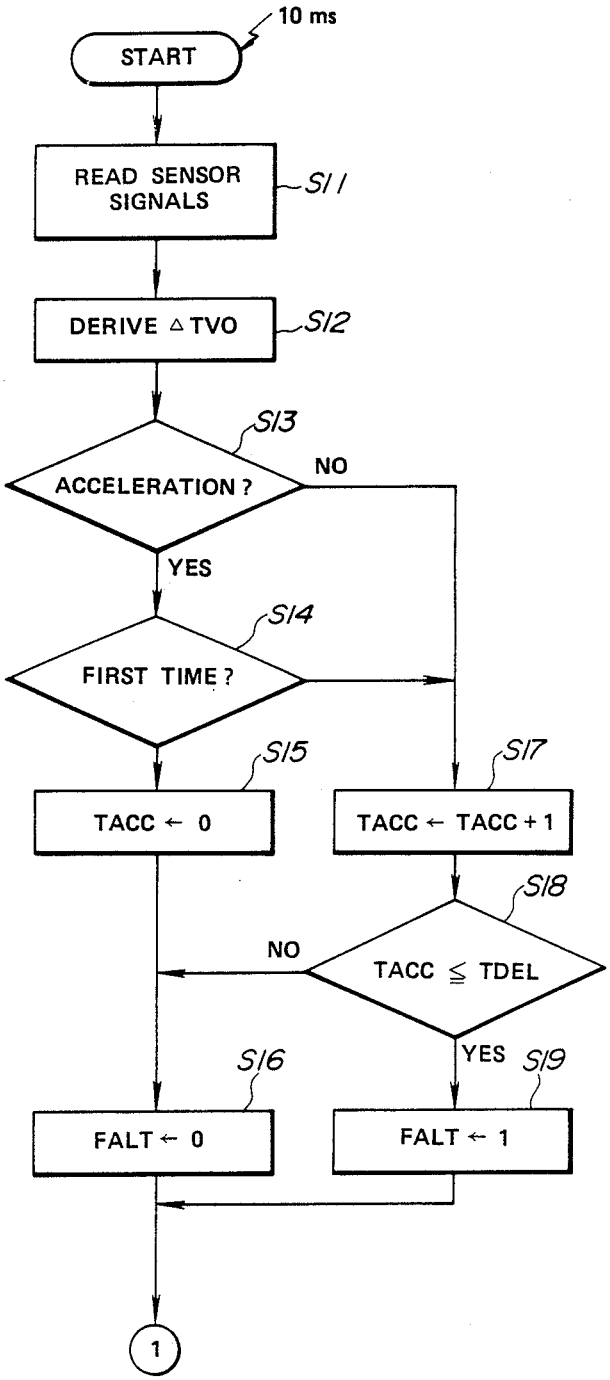
FIGS. 4(A) and 4(B) are flowcharts showing a sequence of an interrupt routine for deriving a fuel injection amount.
Figure 4B:
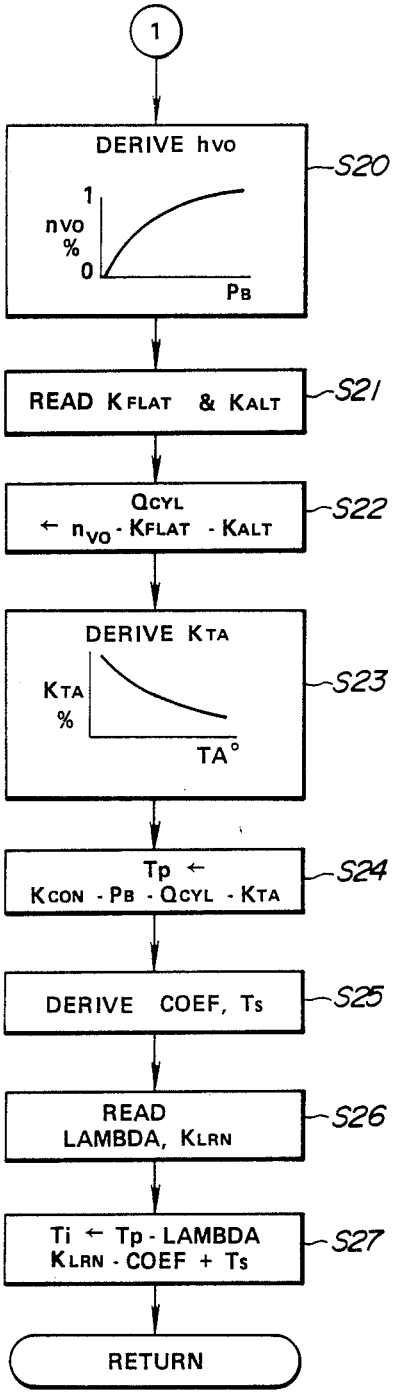

FIGS. 4(A) and 4(B) show a sequence of fuel injection amount Ti derivation routine which is executed at every 10 ms. Immediately after starting execution, input sensor signals including the throttle angle indicative signal TVO are read out at a step S11. At the step S11, the intake air pressure data PB which is derived through the routine of FIG. 3 is also read out. At step S12, a throttle valve angular displacement rate ΔTVO is derived. In practice, the throttle valve angular displacement rate ΔTVO is derived by comparing the throttle angle indicative signal value TVO read in the step S11 with the throttle angle indicative signal value read in the immediately preceding execution cycle. For this purpose, RAM 102 is provided a memory address 111 for storing the throttle angle indicative signal value TVO to be used in derivation of the throttle valve angular displacement rate ΔTVO in the next execution cycle. Therefore, at the end of process in the step S12, the content of the TVO storing memory address 111 is updated by the throttle valve indicative signal value read at the step S11. Then, the throttle valve displacement rate ΔTVO is compared with an acceleration threshold and a deceleration threshold to check whether acceleration or deceleration of the engine is demanded or not, at a step S13.

When the throttle angle displacement rate ΔTVO is greater than or equal to the acceleration threshold or smaller than the deceleration threshold as checked at the step S13, further check is performed at a step S14, whether the current cycle is the first cycle in which the acceleration demand or deceleration is detected. For enabling this judgement, a flag FLACC is set in a flag register 112 in CPU 101 when acceleration or deceleration demand is at first detected. Though there is no illustrated routine of resetting the FLACC flag in the flag register 112, it may be preferable to reset the FLACC flag after a given period of termination of the acceleration or deceleration demand.

When the first occurrence of acceleration or deceleration demand is detected at the step S15, a timer 113 for measuring a period of time, in which acceleration or deceleration demand is maintained is maintained, is reset to clear a timer value TACC to zero (0). After the step S14, a flag FALT in a flag register 114 which is indicative of enabling state of learning of assuming of altitude depending upon the engine driving condition while it is set and indicative of inhibited state of learning while it is reset, is reset at a step S16.

On the other hand, when the acceleration or deceleration demand is not detected as checked at the step S13 or when the FLACC flag of the FLACC flag register is set as checked at the step S14, the timer value TACC of the TACC timer 113 is incremented by 1, at a step S17. Thereafter, the timer value TACC is compared with a delay time indicative reference value TDEL which represents lag time between injection timing of the fuel and delivery timing of the fuel to the engine cylinder, at a step S18. Consequently, the time indicative reference value TDEL is variable depending upon the atomization characteristics of the fuel. When the timer value TACC is greater than the time indicative reference value TDEL, process goes to the step S16. On the other hand, when the timer value TACC is smaller than or equal to the time indicative reference value, the FALT flag is set at a step S19.

Figure 10:
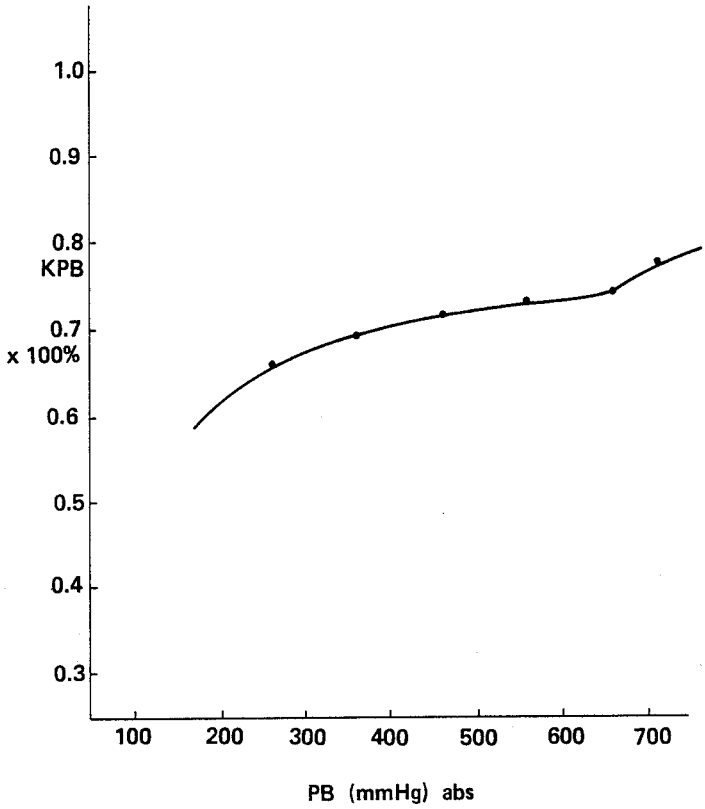
FIG. 10 is a graph showing basic induction volume efficiency versus an intake air pressure, experimentally obtained.

After one of the steps S16 and S19, process goes to a step S20 of FIG. 4(B). At the step S20, a basic induction volumetric efficiency $\eta_{vo}$ (%) is derived in terms of the intake air pressure data PB. The experimentally derived relationship between the intake air pressure PB and the induction volumetric efficiency $\eta_{vo}$ is shown in FIG. 10. In order to derive the basic induction volumetric efficiency $\eta_{vo}$, one-dimensional table is set in a memory block 115 of ROM 103, which memory block will be hereafter referred to as $\eta_{vo}$ map. At a step S21, an engine condition dependent volumetric efficiency correction coefficient $K_{FLAT}$ which will be hereafter referred to as $K_{FLAT}$ correction coefficient, and altitude dependent correction coefficient $K_{ALT}$ which will be hereafter referred to as $K_{ALT}$ correction coefficient are read out. Then, at a step S22, an induction volumetric efficiency $Q_{CYL}$ is derived by the following equation:

$$Q_{CYL}=\eta_{vo}\times K_{FLAT}\times K_{ALT}$$

After the step S22, in which the induction volume efficiency $Q_{CYL}$ is derived, the intake air temperature signal value Ta is read at a step S23. At the step S23, it is also performed to derive an intake air temperature dependent correction coefficient $K_{TA}$, which will be hereafter referred to as $K_{TA}$ correction coefficient. Practically, in order to enable derivation of the intake air temperature dependent is performed by map look us against a memory address 116 of ROM 103, in which map of the intake air temperature dependent correction coefficient $K_{TA}$ is set in terms of the intake air temperature Ta.

A basic fuel injection amount Tp is derived at a step S24 according to the following equation:

$$Tp=K_{con}\times PB\times Q_{CYL}\times K_{TA}$$

At a step S25, a correction coefficient COEF which includes an acceleration enrichment correction coefficient, a cold engine enrichment correction coefficient and so forth as components, and a battery voltage compensating correction value Ts are derived. Derivation of the correction coefficient COEF is performed in per se well known manner which does not require further discussion. At a step S26, an air/fuel ratio dependent feedback correction coefficient $K_\lambda$ which will be hereafter referred to as $K_\lambda$ correction coefficient, and a learning correction coefficient $K_{LRN}$ which is derived through learning process discussed later and will be hereafter referred to as $K_{LRN}$ correction coefficient are read out. Then, at a step S27, the fuel injection amount Ti is derived according to the following equation:

$$Ti=Tp\times K_\lambda\times K_{LRN}\times COEF+Ts$$

The control unit 11 derives a fuel injection pulse having a pulse width corresponding to the fuel injection amount Ti and set the fuel injection pulse in the temporary register in the fuel injection signal output circuit 107.

Figure 5A:
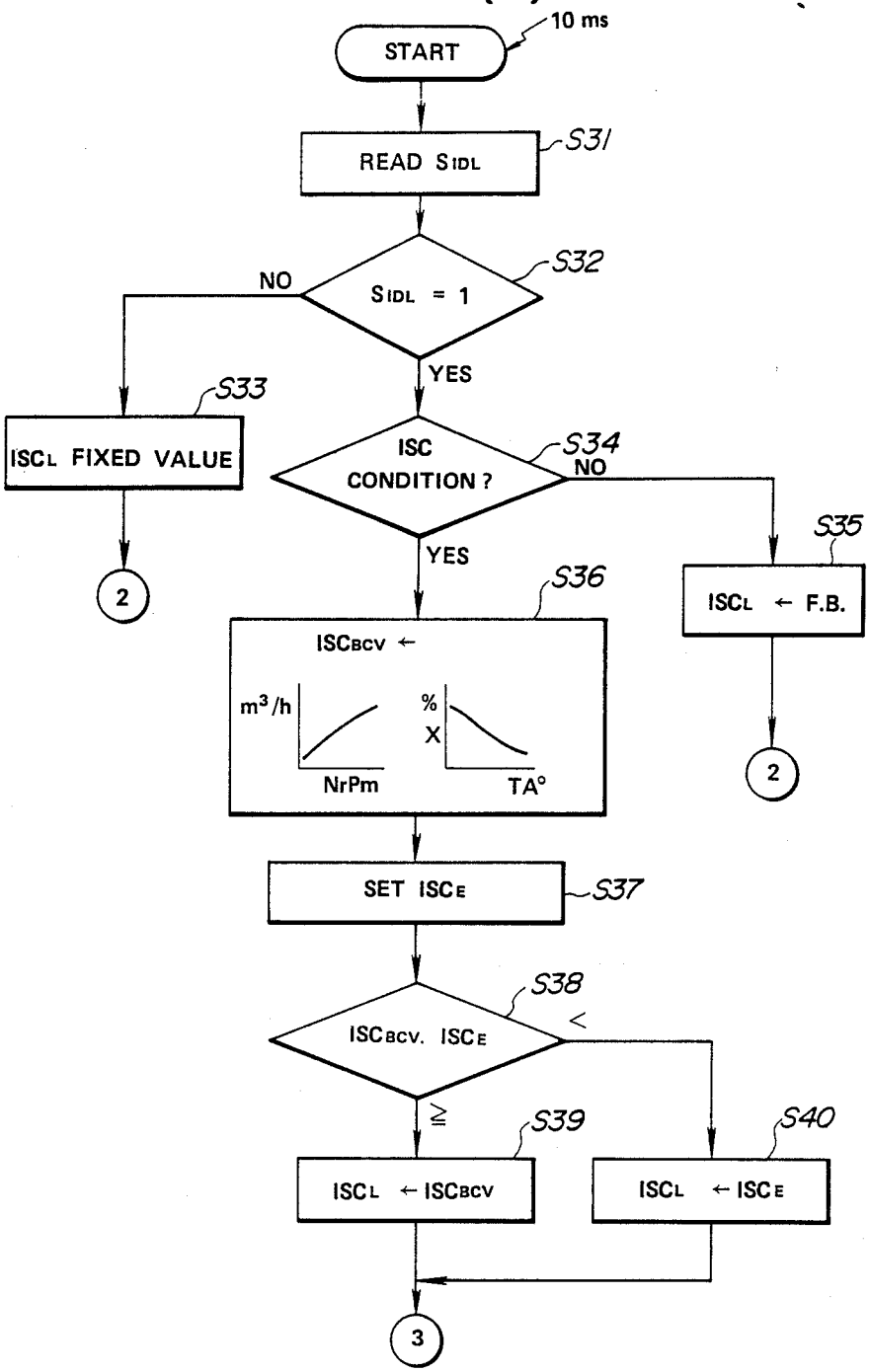
FIGS. 5(A) and 5(B) are flowcharts showing a sequence of interrupt routine for setting an engine idling controlling duty ratio and assuming an altitude for altitude dependent fuel supply amount correction.
Figure 5B:
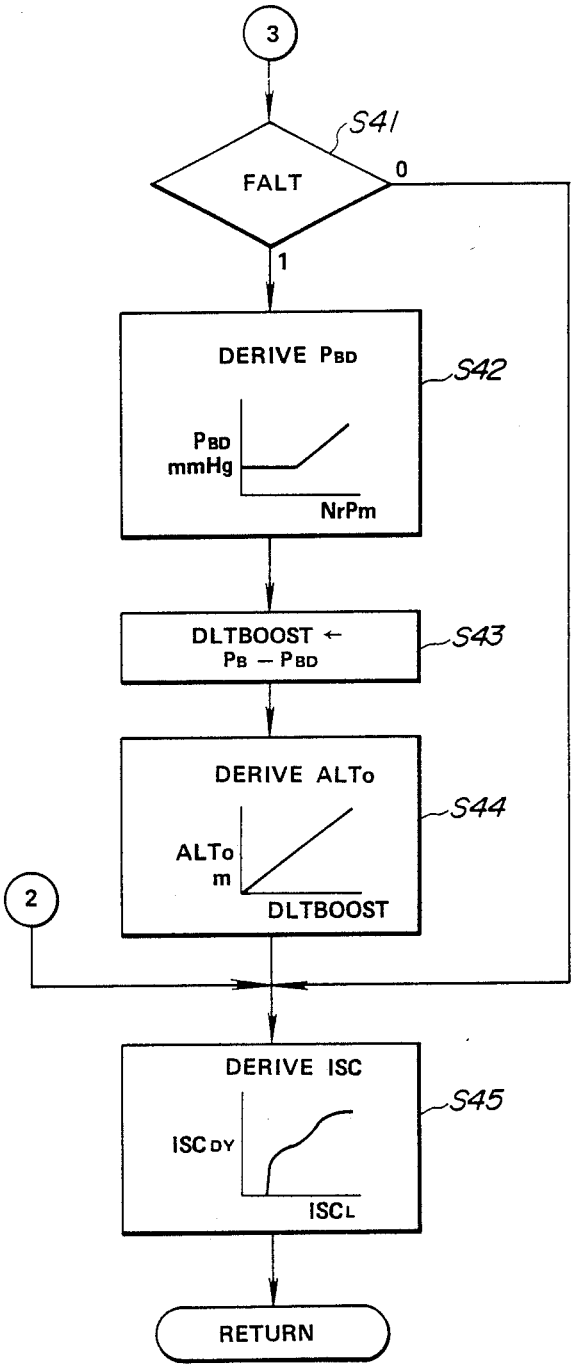

FIGS. 5(A) and 5(B) show a sequence of routine for deriving an idling speed control pulse signal and assuming altitude. The shown routine in FIGS. 5(A) and 5(B) is performed at every 10 ms. The trigger timing of this routine is shifted in phase at 5 ms relative to the routine of FIGS. 4(A) and 4(B) and therefore will not interfere to each other.

Immediately after starting execution, a signal level of the idle switch signal $S_{IDL}$ from the idle switch 8a is read at a step S31. Then, the idle switch signal level $S_{IDL}$ is checked whether it is one (1) representing the engine idling condition or not, at a step S32. When the idle switch signal level $S_{IDL}$ is zero (0) as checked at the step S32 and thus indicate that the engine is not in idling condition, an auxiliary air flow rate $ISC_L$ is set at a given fixed value which is derived on the basis of the predetermined auxiliary air control parameter, such as the engine coolant temperature Tw, at a step S33. On the other hand, when the idle switch signal level $S_{IDL}$ is one as checked at the step S32 and thus represents the engine idling condition, the engine driving condition is checked at a step S34 whether a predetermined FEEDBACK control condition which will be hereafter referred to as ISC condition, is satisfied or not. In the shown embodiment, the engine speed data N, the vehicle speed data VSP and the HIGH level transmission neutral switch signal $N_T$ are selected as ISC condition determining parameter. Namely, ISC condition is satisfied when the engine speed data N is smaller than or equal to an idling speed criterion, the vehicle speed data VSP is smaller than a low vehicle speed critrion, e.g. 8 km/h, and the transmission neutral switch signal level is HIGH.

When ISC condition is not satisfied as checked at the step S34, the auxiliary air flow control signal $ISC_L$ is set at a feedback control value F.B. which is derived to reduce a difference between the actual engine speed and a target engine speed which is derived on the basis of the engine coolant temperature, at a step S35. On the other hand, when the ISC condition is satisfied as checked at the step S34, a boost controlling auxiliary air flow rate $ISC_{BCV}$ is set at a value determined on the basis of the engine speed indicative data N and the intake air temperature Ta for performing boost control to maintain the vacuum pressure in the intake manifold constant, at a step S36. As seen in the block of the step S36 in FIG. 5(A), the auxiliary air flow rate ($m^3/h$) is basically determined based on the engine speed indicative data N and is corrected by a correction coefficient (%) derived on the basis of the intake air temperature Ta.

At a step S37, an stable engine auxiliary air flow rate $ISC_E$ is derived at a value which can prevent the engine from falling into stall condition and can maintain the stable engine condition. Then, the stable engine auxiliary air flow rate $ISC_E$ is compared with the boost controlling auxiliary air flow rate $ISC_{BCV}$ at a step S38. When the boost controlling auxiliary air flow rate $ISC_{BCV}$ is greater than or equal to the stable engine auxiliary air flow rate $ISC_E$, the boost controlling auxiliary air flow rate $ISC_{BVC}$ is set as the auxiliary air control signal value $ISC_L$, at a step S39. On the other hand, when the stable engine auxiliary air flow rate $ISC_E$ is greater than the boost controlling auxiliary air flow rate $ISC_{BCV}$, the auxiliary air control signal value $ISC_L$ is set at the value of the stable engine auxiliary air flow rate $ISC_E$ at a step S40.

After one of the step S39 and S40, the FALT flag is checked at a step S41. When the FALT flag is set as checked at the step S41, an intake air pressure $P_{BD}$ during deceleration versus the engine speed indicative data N is derived at a step S42, which intake air pressure will be hereafter referred to as decelerating intake air pressure. In practice, the decelerating intake air pressure $P_{BD}$ is set in one-dimensional map stored in a memory block 117 in ROM 103. The $P_{BD}$ map is looked up in terms of the engine speed indicative data N. Then, a difference of the intake air pressure $P_B$ and the decelerating intake air pressure $P_{BD}$ is derived at a step S43, which difference will be hereafter referred to as pressure difference data ΔBOOST. Utilizing the pressure difference data ΔBOOST derived at the step S43, an assumed altitude data $ALT_0$ (m) is derived. The assumed altitude data $ALT_0$ is set in a form of a map set in a memory block 118 so as to be looked up in terms of the pressure difference data ΔBOOST.

After one of the step S33, S35 and S44 or when the FALT flag is not set as checked at the step S41, an auxiliary air control pulse width $ISC_{DY}$ which defines duty ratio of OPEN period and CLOSE period of the auxiliary air control valve 19, is derived on the basis of the auxiliary air control signal value at a step S45.

Figure 6:
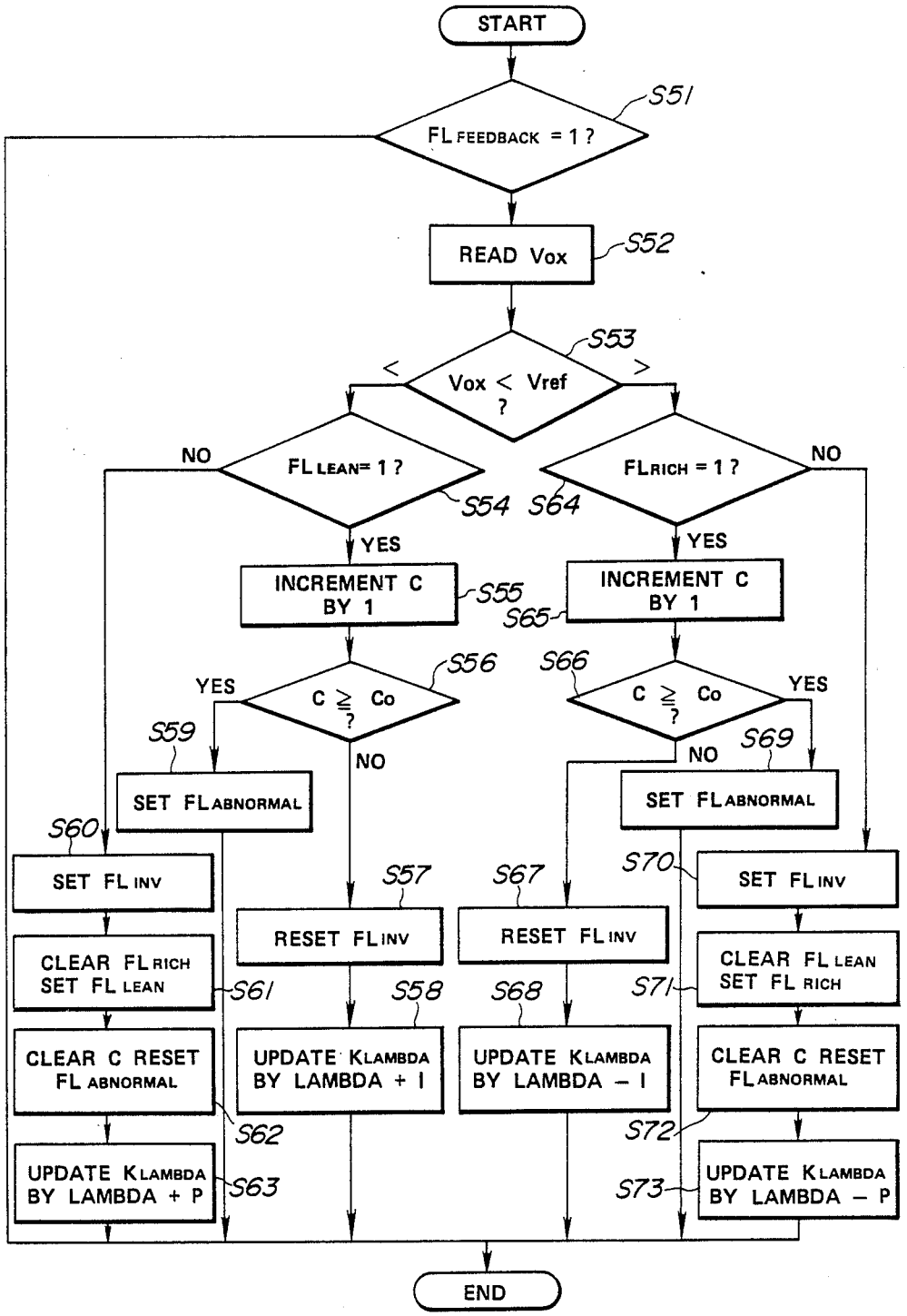
FIG. 6 is a flow chart of an interrupt routine for deriving an air/fuel ratio feedback controlling correction coefficient on the basis of an oxygen concentration in an exhaust gas.
Figure 7:
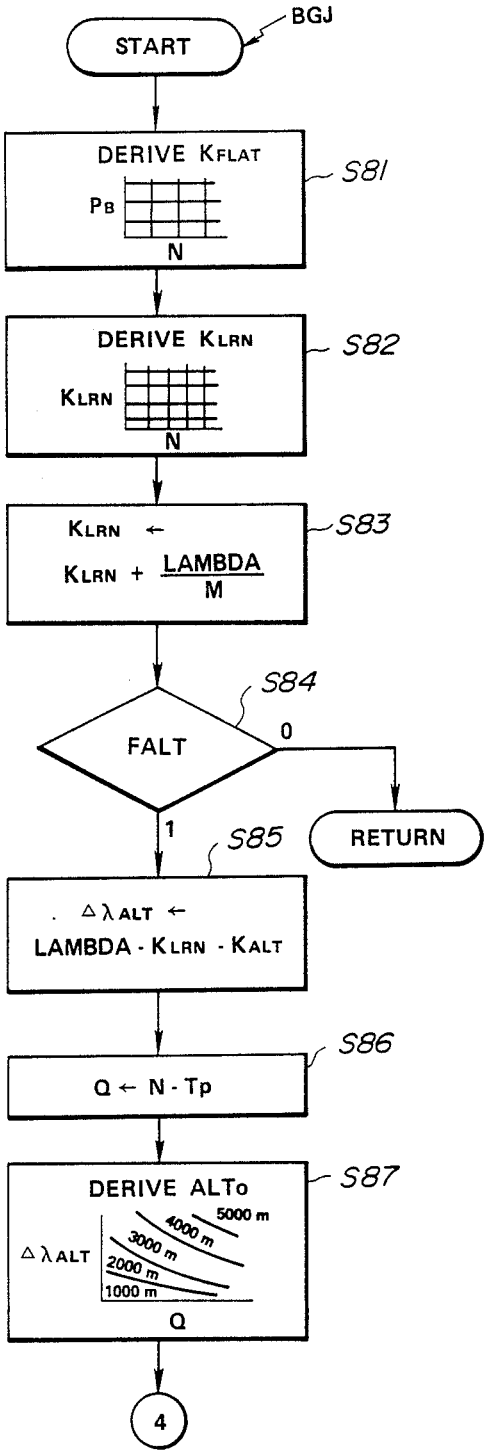
FIGS. 7(A) and 7(B) are flowcharts showing a sequence of background job executed by the control unit of FIG. 2.
Figure 7:
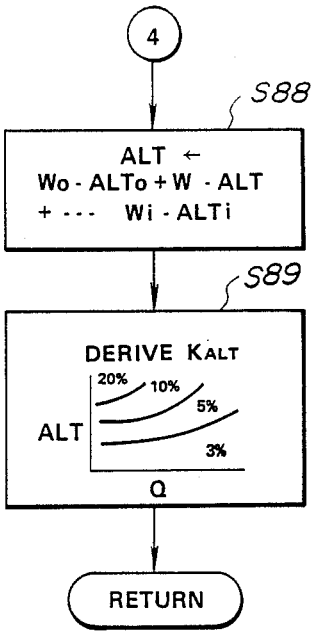

FIG. 6 shows a routine for deriving the feedback correction coefficient $K_\lambda$. The feedback correction coefficient $K_\lambda$ is composed of a proportional (P) component and an integral (I) component. The shown routine is triggered every given timing in order to regularly update the feedback control coefficient $K_\lambda$. In the shown embodiment, the trigger timing of the shown routine is determined in synchronism with the engine revolution cycle. The feedback control coefficient $K_\lambda$ is stored in a memory block 118 and cyclically updated during a period in which FEEDBACK control is performed.

At a step S51, the engine driving condition is checked whether it satisfies a predetermined condition for performing air/fuel ratio dependent feedback control of fuel supply. In practice, a routine (not shown) for governing control mode to switch the mode between FEEDBACK control mode and OPEN LOOP control mode based on the engine driving condition is performed. Basically, FEEDBACK control of air/fuel ratio is taken place while the engine is driven under load load and at low speed and OPEN LOOP control is performed otherwise. In order to selectively perform FEEDBACK control and OPEN LOOP control, the basic fuel injection amount Tp is taken as a parameter for detecting the engine driving condition. For distinguishing the engine driving condition, a map containing FEEDBACK condition indicative criteria $Tp_{ref}$ is set in an appropriate memory block of ROM. The map is designed to be searched in terms of the engine speed N. The FEEDBACK condition indicative criteria set in the map are experimentally obtained and define the engine driving range to perform FEEDBACK control.

The basic fuel injection amount Tp derived is then compared with the FEEDBACK condition indicative criterion $Tp_{ref}$. When the basic fuel injection amount Tp is smaller than or equal to the FEEDBACK condition indicative criterion $Tp_{ref}$ a delay timer in the control unit and connected to a clock generator, is reset to clear a delay timer value. On the other hand, when the basic fuel injection amount Tp is greater than the FEEDBACK condition indicative criterion $Tp_{ref}$ the delay timer value $t_{DELAY}$ is read and compared with a timer reference value $t_{ref}$. If the delay timer value $t_{DELAY}$ is smaller than or equal to the timer reference value $t_{ref}$, the engine speed data N is read and compared with an engine speed reference $N_{ref}$. The engine speed reference $N_{ref}$ represents the engine speed criterion between high engine speed range and low engine speed range. Practically, the engine speed reference $N_{ref}$ is set at a value corresponding to a high/low engine speed criteria, e.g. 3800 r.p.m. When the engine speed indicative data N is smaller than the engine speed reference $N_{ref}$, or after the step 1106, a FEEDBACK condition indicative flag $FL_{FEEDBACK}$ which is to be set in a flag register 119 in the control unit 100, is set. When the delay timer value $t_{DELAY}$ is greater than The timer reference value $t_{ref}$, a FEEDBACK condition indicative flag $FL_{FEEDBACK}$ is reset.

By providing the delay timer to switch mode of control between FEEDBACK control and OPEN LOOP control, hunting in selection of the control mode can be successfully prevented. Furthermore, by providing the delay timer for delaying switching timing of control mode from FEEDBACK control to OPEN LOOP mode, FEEDBACK control can be maintained for the period of time corresponding to the period defined by the timer reference value. This expands period to perform FEEDBACK control and to perform learning.

Therefore, at the step S51, a FEEDBACK condition indicative flag $FL_{FEEDBACK}$ is checked. When the FEEDBACK condition indicative flag $FL_{FEEDBACK}$ is not set as checked at the step S51, which indicates that the on-going control mode is OPEN LOOP. Therefore, process directly goes END. At this occasion, since the feedback correction coefficient $K_\lambda$ is not updated, the content in the memory block 118 storing the feedback correction coefficient is held in unchanged.

When the FEEDBACK condition indicative flag $FL_{FEEDBACK}$ is set as checked at a step S51, the oxygen concentration indicative signal $O_2$ from the oxygen sensor 14 is read out at a step S52. The oxygen concentration indicative signal value $O_2$ is then compared with a predetermined rich/lean criterion $V_{ref}$ which corresponding to the air/fuel ratio of stoichiometric value, at a step S53. In practice, in the process, judgment is made that the air/fuel mixture is lean when the oxygen concentration indicative signal value $O_2$ is smaller than the rich/lean criterion $V_{ref}$, a lean mixture indicative flag $FL_{LEAN}$ which is set in a lean mixture indicative flag register 120 in the control unit 100, is checked at a step S54.

On the other hand, when the lean mixture indicative flag $FL_{LEAN}$ is set as checked at the step S54, a counter value C of a faulty sensor detecting timer 121 in the control unit 100 is incremented by one (1), at a step S55. The counter value C will be hereafter referred to as faulty timer value. The, the faulty timer value C is compared with a preset faulty timer criterion $C_0$ which represents acceptable maximum period of time to maintain lean mixture indicative $O_2$ sensor signal while the oxygen sensor 20 operates in normal state, at a step S56. When the faulty timer value C is smaller than the faulty timer criterion $C_0$, the rich/lean inversion indicative flag $FL_{INV}$ is reset at a step S57. Thereafter, the feedback correction coefficient $K_\lambda$ is updated by adding a given integral constant (I constant), at a step S58. On the other hand, when the faulty timer value C as checked at the step S56 is greater than or equal to the faulty timer criterion $C_0$, a faulty sensor indicative flag $FL_{ABNORMAL}$ is set in a flag register 123 at a step S59. After setting the faulty sensor indicative flag $FL_{ABNORMAL}$ process goes END.

On the other hand, when the lean mixture indicative flag $FL_{LEAN}$ is not set as checked at the step S54, fact of which represents that the air/fuel mixture ratio is adjusted changed from rich to lean, an rich/lean inversion indicative flag $FL_{INV}$ which is set in a flag register 122 in the control unit 100, is set at a step S60. Thereafter, a rich mixture indicative flag $FL_{RICH}$ which is set in a flag register 124, is reset and the lean mixture indicative flag $FL_{LEAN}$ is set, at a step S61. Thereafter, the faulty timer value C in the faulty sensor detecting timer 121 is reset and the faulty sensor indicative flag $FL_{ABNORMAL}$ is reset, at a step S62. Then, the feedback correction coefficient $K_\lambda$ is modified by adding a proportional constant (P constant), at a step S63.

On the other hand, when the oxygen concentration indicative signal value $O_2$ is greater than the rich/lean criterion $V_{ref}$ as checked at the step S53, a rich mixture indicative flag $FL_{RICH}$ which is set in a rich mixture indicative flag register 124 in the control unit 100, is checked at a step S64.

When the rich mixture indicative flag $FL_{RICH}$ is set as checked at the step S64, the counter value C of the faulty sensor detecting timer 121 in the control unit 100 is incremented by one (1), at a step S65. The, the faulty timer value C is compared with the preset faulty timer criterion $C_0$, at a step S66. When the faulty timer value C is smaller than the faulty timer criterion $C_0$, the rich-/lean inversion indicative flag $FL_{INV}$ is reset at a step S67. Thereafter, the feedback correction coefficient $K_\lambda$ is updated by subtracting the I constant, at a step S68.

On the other hand, when the faulty timer value C as checked at the step S66 is greater than or equal to the faulty timer criterion $C_0$, a faulty sensor indicative flag $FL_{ABNORMAL}$ is set at a step S69. After setting the faulty sensor indicative flag $FL_{ABNORMAL}$ process goes END.

When the rich mixture indicative flag $FL_{RICH}$ is not set as checked at the step S64, fact of which represents that the air/fuel mixture ratio is just changed from lean to rich, an rich/lean inversion indicative flag $FL_{INV}$ which is set in a flag register 122 in the control unit 100, is set at a step S70. Thereafter, a rich mixture indicative flag $FL_{LEAN}$ is reset and the rich mixture indicative flag $FL_{RICH}$ is set, at a step S71. Thereafter, the faulty timer value C in the faulty sensor detecting timer 121 is reset and the faulty sensor indicative flag $FL_{ABNORMAL}$ is reset, at a step S72. Then, the feedback correction coefficient $K_\lambda$ is modified by subtracting the P constant, at a step S73.

After one of the process of the steps S58, S59, S63, S68, S69 and S73, process goes to the END.

It should be noted that, in the shown embodiment, the P component is set at a value far greater than that of I component.

FIGS. 7(A) and 7(B) show a sequence of a routine composed as a part of the main program to be executed by the control unit 11 as the background job. The shown routine is designed to derive $K_{FLAT}$ correction coefficient, $K_{LRN}$ correction coefficient and altitude dependent correction coefficient, and to derive the assumed altitude.

At a step S81 which is triggered immediately after starting shown routine, $K_{FLAT}$ correction coefficient is derived in terms of the engine speed data N and the intake air pressure data PB for correcting the basic induction volumetric efficiency $\eta_{vo}$. In practice, the $K_{FLAT}$ correction coefficients are set in a form of two-dimensional look-up table in a memory block 125 of ROM 102. Therefore, the $K_{FLAT}$ correction coefficient is derived through map look up in terms of the engine speed data N and the intake air pressure data PB.

Here, as will be appreciated that magnitude of variation of the induction volumetric efficiency in relation to variation of the engine speed is relative small. Therefore, the $K_{FLAT}$ correction coefficient can be set as a function of the intake air pressure PB. In this case, since the variation range of the $K_{FLAT}$ correction coefficient can be concentrated in the vicinity of one (1). Therefore, number of grid for storing the correction coefficient values for deriving the $K_{FLAT}$ correction coefficient in terms of the engine speed and the intake air pressure can be small. In addition, since delay of updating of the $K_{FLAT}$ correction coefficient cannot cause substantial error, interval of updating of the $K_{FLAT}$ correction coefficient can be set long enough to perform in the background job. Although the updating interval is relatively long, accuracy in derivation of the induction volumetric efficiency can be substantially improved in comparison with the manner of derivation described in the aforementioned Tokkai Showa No. 58-41230, in which the correction coefficient is derived solely in terms of the engine speed, since the $K_{FLAT}$ correction coefficient derived in the shown routine is variable depending on not only the engine speed data N but also the intake air pressure PB.

At a step S82, the $K_{LRN}$ correction coefficient is derived on the basis of the engine speed data N and the basic fuel injection amount Tp. In order to enable this, a $K_{LRN}$ correction coefficients are set in a form of a two-dimensional look-up map in a memory address 126 in RAM 103. The $K_{LRN}$ correction coefficient derived at the step S82 is modified by adding a given value derived as a function of an average value of $K_\lambda$ correction coefficient for updating the content in the address of the memory block 126 corresponding to the instantaneous engine driving range at a step S83. In practice, updating value $K_{LRN(new)}$ of the $K_{LRN}$ correction coefficient is derived by the following equation:

$$K_{LRN(new)}=K_{LRN}+K_\lambda/M$$

where M is a given constant value.

Thereafter, the FALT flag is checked at a step S84. When the FALT flag is not set, process goes END. On the other hand, when the FALT flag is set as checked at the step S84, an error value $\Delta\lambda_{ALT}$ which represents an error from a reference air/fuel ratio ($\lambda=1$) due to altitude variation, at a step S85. In the process done in the step S85, the error value $\Delta\lambda_{ALT}$ corresponds a product by multiplying the average value $K_\lambda$ by the modified $K_{LRN}$ correction coefficient $K_{LRN(new)}$ and the $K_{ALT}$ correction coefficient.

At a step S86, an intake air flow rate data Q is derived by multiplying the basic fuel injection amount Tp by the engine speed data N. Then, based on the error value $\Delta\lambda_{ALT}$ derived at the step S85 and the intake air flow rate data Q derived at the step S86, an altitude indicative data $ALT_0$ is derived from a two-dimensional map stored in a memory block 127 of RAM 103.

Here, as will be appreciated, the error value $\Delta\lambda_{ALT}$ is increased according to increasing of altitude which cases decreasing of air density. On the other hand, the error value $\Delta\lambda_{ALT}$ decreases according to increasing of the intake air flow rate Q. Therefore, the variation of the altitude significantly influence for error value $\Delta\lambda_{ALT}$. Therefore, in practice, the assumed altitude $ALT_0$ to be derived in the step S87 increases according to decreasing of the intake air flow rate Q and according to increasing of the error value $\Delta\lambda_{ALT}$.

The assumed altitude data $ALT_0$ is stored in a shift register 128.

Figure 8:
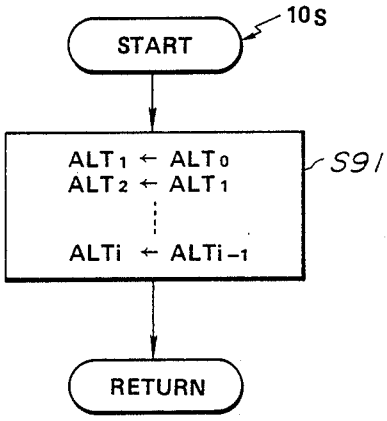
FIG. 8 is a flowchart of a routine for deriving an average assumed altitude.
Figure 9:
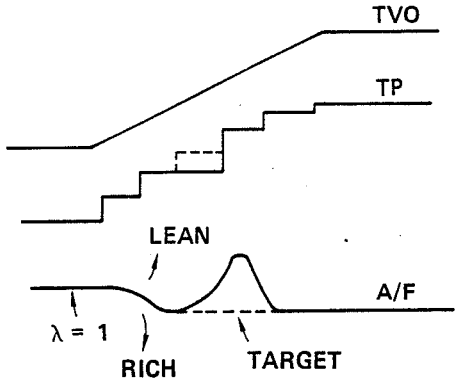
FIG. 9 is a chart showing relationship between an air/fuel ratio, basic fuel injection amount Tp and a throttle valve angle.

At a step S88, an average value $\overline{ALT}$ of the assumed altitude $ALT_0$ is derived over given number (i) of precedingly derived assumed altitude data $ALT_0$. For enabling this, the interrupt routine of FIG. 8 is performed at every given timing, e.g. every 10 sec. In the routine of FIG. 8, sorting of the stored assumed altitude data ALT is performed at a step S91. Namely, the shift register 128 is operated to sort the assumed altitude data ALT in order of derivation timing. Namely, most recent data is set as $ALT_1$ and the oldest data is set as $ALT_i$.

At the step S88, the average altitude data $\overline{ALT}$ is derived by the following equation:

$$ALT = W_0 \times ALT_0 + W_1 \times ALT_1 \ldots W_i \times ALT_i$$

where $W_0, W_1 \ldots W_i$ are constant ($W_0 > W_1 > \ldots > W_i$; $W_0 + W_1 \ldots W_i = 1$)

Utilizing the intake air flow rate data Q derived at the step S86 and the average altitude data $\overline{ALT}$ derived at the step S88, the $K_{ALT}$ correction coefficient is derived, at a step S89. In the process of the step S89, map lookup against a two-dimensional map set in a memory block 129 in ROM 102 is performed in terms of the intake flow rate Q and the average altitude data $\overline{ALT}$.

Here, it will be noted that when the altitude is increased to case decreasing of the atmospheric pressure to reduce resistance for exhaust gas. Therefore, at higher altitude, induction volumetric efficiency is increased even at the same intake air pressure to that in the lower altitude. By this, the air/fuel mixture to be introduced into the engine cylinder becomes leaner. On the other hand, the exhaust pressure becomes smaller as decreasing the intake air flow rate and thus subject greater influence of variation of the atmospheric pressure. Therefore, the $K_{ALT}$ correction coefficient is set to be increased at higher rate as increasing of the average altitude data $\overline{ALT}$ and as decreasing the intake air flow rate Q.

In summary, a fuel injection amount in L-Jetronic type fuel injection is derived on the basis of the engine speed N and the intake air flow rate Q. As is well known, the basic fuel injection amout is derived by:

$$Tp = K_{cONL} \times Q/N$$

where $K_{CONL} = F/A$ ($F/I$ gradient) $\times 1/60 \times$ (number of cylinder)

F/A: reciprocal of air/fuel ratio $$F/I \text{ gradient (ms/kg)} = 1/(\text{fuel flow rate per injection } (l) \times \rho$$

$\rho$: specific gravity of fuel

Here, the intake air flow rate Q can be illustrated by:

$$\begin{aligned} Q &= n = PV/RT \\ &= (Pn \times V_0 \times \eta_v \times N)/2R_m \times Tm \end{aligned}$$

where

Pn=P $V = \frac{1}{2} V_0 \times \eta_v \times N$ $\eta_v$ is volumetric efficiency R=Rm (=29.27)

T=Tm

PV=nRT K M (equation of state of gas)

$V_0$: total exhaust gas amount M

Tm: absolute temperature of intake air T;

n: intake air weight K

R: constant of gas M $T^{-1}$

From the above equation, the equation for deriving Tp can be modified to:

$$Tp = K_{CONL} \times \{(N \times 60 \times V_0)/(2\ Rm \times Tm_{ref}) \times Pn \times \eta_v \times K_{TA}\}/N$$

where $l/Tm = K_{TA/Tmref}$ $Tm_{ref}$ is a reference temperature, e.g. 30° C.

$K_{TA}$ is a intake air temperature dependent correction coefficient which becomes 1 when the intake air temperature is reference temperature and increases according to lowering of the intake air temperature below the reference temperature and decreases according to rising of the intake air temperature above the reference temperature. Here, assuming $$K_{COND} = K_{CONL} \times (60 \times V_0)/(2\ Rm \times 303°\ K)$$

the equation for deriving Tp can be modified as follow:

$$K_{COND} = K_{CONL} \times (60 \times V_0)/(2\ Rm \times 303°\ K)$$

$$\begin{aligned} \eta_v &= \text{(intake air volume)/(cylinder volume)} \\ &= K_{PB} \times K_{FLAT} \times K_{ALT} \end{aligned}$$

$$\begin{aligned} K_{ALT} &= \text{(intake air volume)/(reference intake air volume)} \\ &= (Vro - Vr')/(Vro - Vr'_{ref}) \\ &= \{Vro \times (1 - Vr'/Vro)\}/\{Vro \times (1 - Vr'_{ref}/Vro)\} \end{aligned}$$

where

Vro is BDC (bottom dead center) cylinder volume;

Vr' is BDC remained exhaust gas volume; and $Vr'_{ref}$ is standard remained exhaust gas volume $= \{1 - 1/E \times (Vr'/Vr)\}/\{1 - 1/E \times (Vr'_{ref}/Vr)\}$ Vr is TDC (top dead center) cylinder volume $$\begin{aligned} Vr &= 1/E \times Vro \\ &= \{1 - 1/E \times (Pr/PB)\}/\{1 - 1/E \times (Pr_{ref}/PB)\} \end{aligned}$$

$$Vr'/Vr = (Pr/PB)^{1/K}$$

E: compression ratio;

K: relative temperature;

Pr: exhaust gas pressure (abs)

As will be appreciated herefrom, by employing the $K_{ALT}$ correction coefficient, error in $\lambda$ control, altitude dependent error versus of the intake air pressure in deceleration or in acceleration at a certain altitude versus that in the standart altitude, can be satisfactorily compensated without requiring an exhaust pressure sensor and atmospheric pressure sensor.

Figure 11:
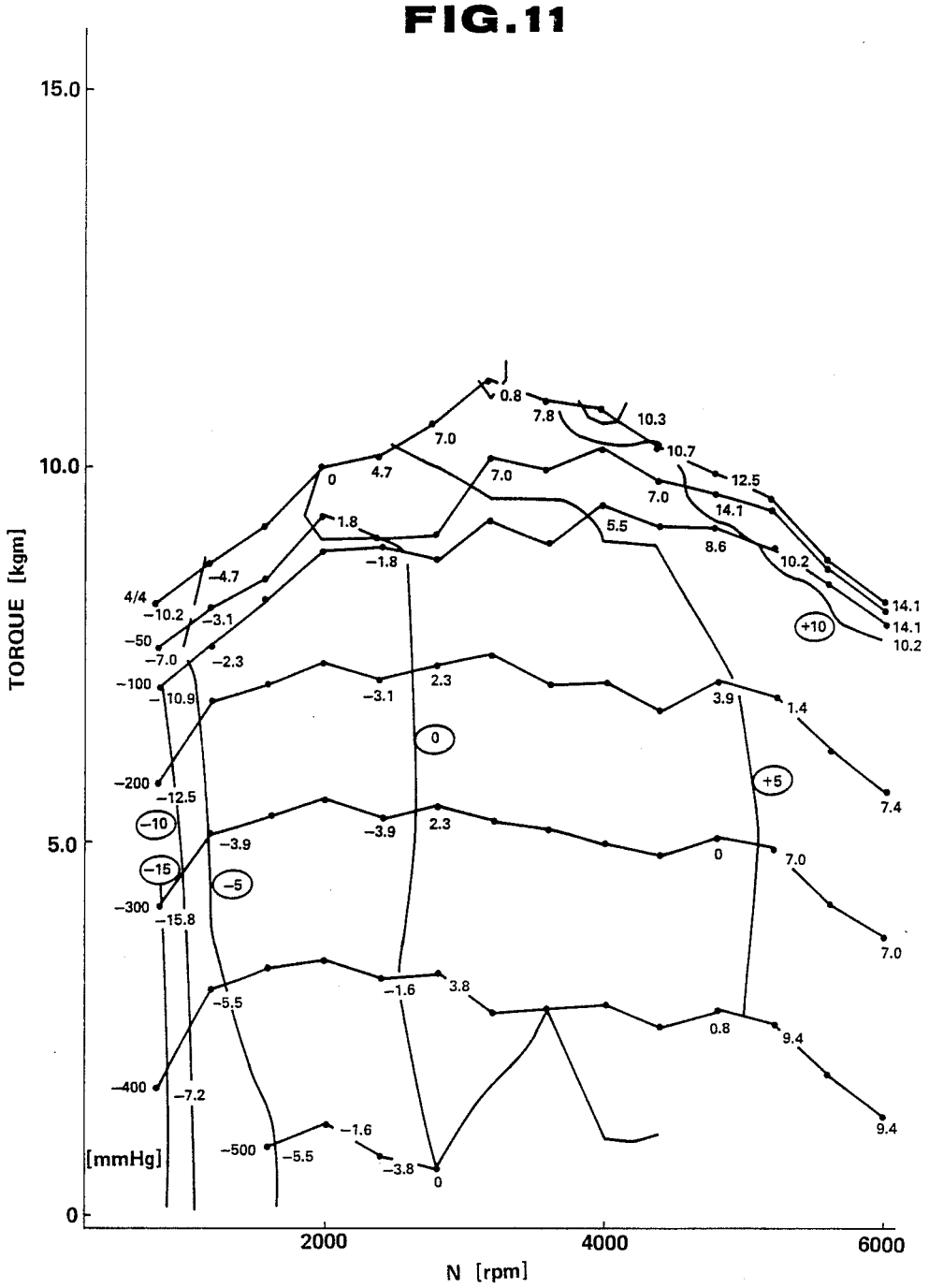
FIG. 11 is a graph showing experimentally obtained induction volumetric efficiency correction value versus engine revolution speed.
Figure 12:
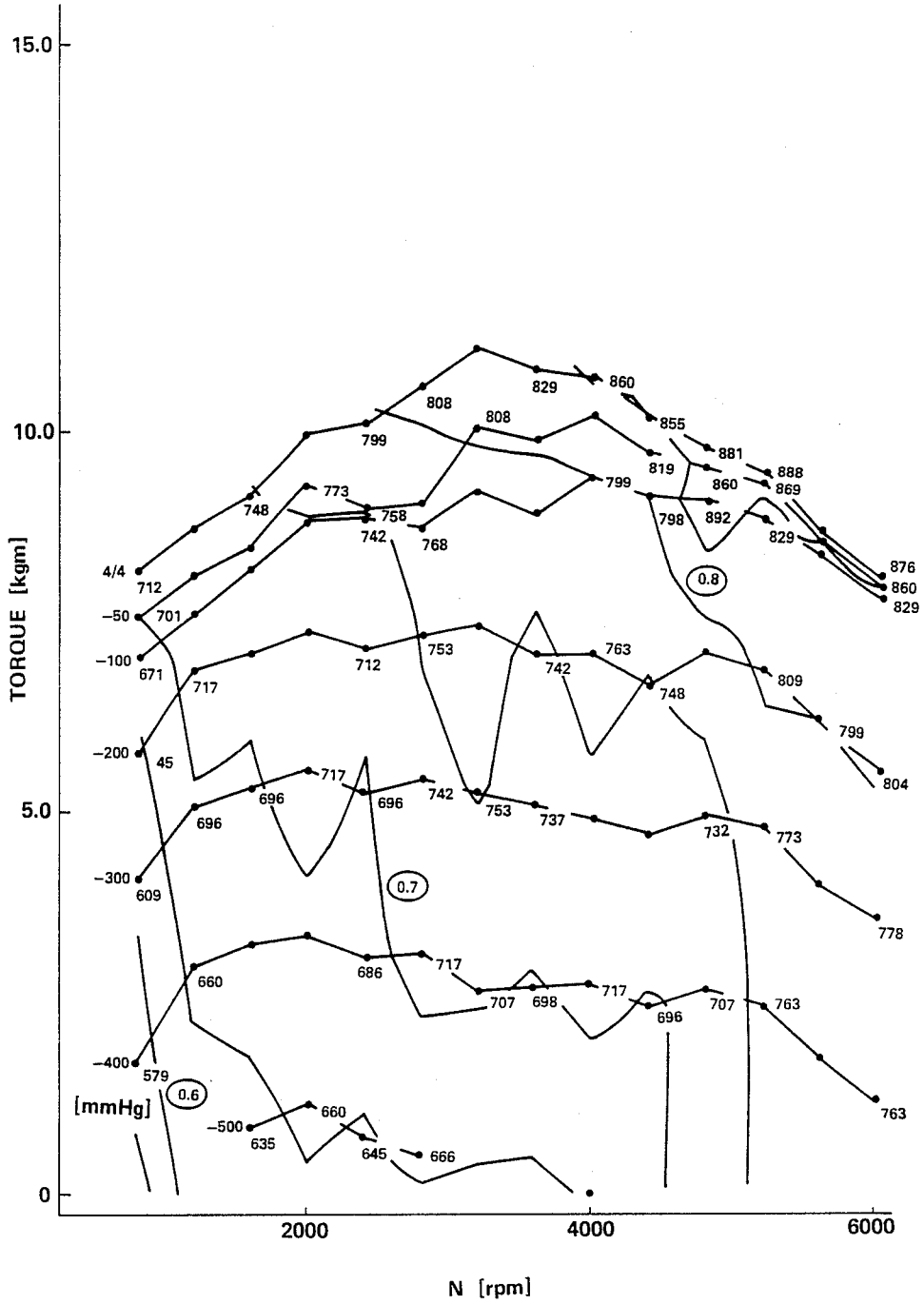
FIG. 12 is a graph showing experimentally obtained induction volumetric efficiency.
Figure 13:
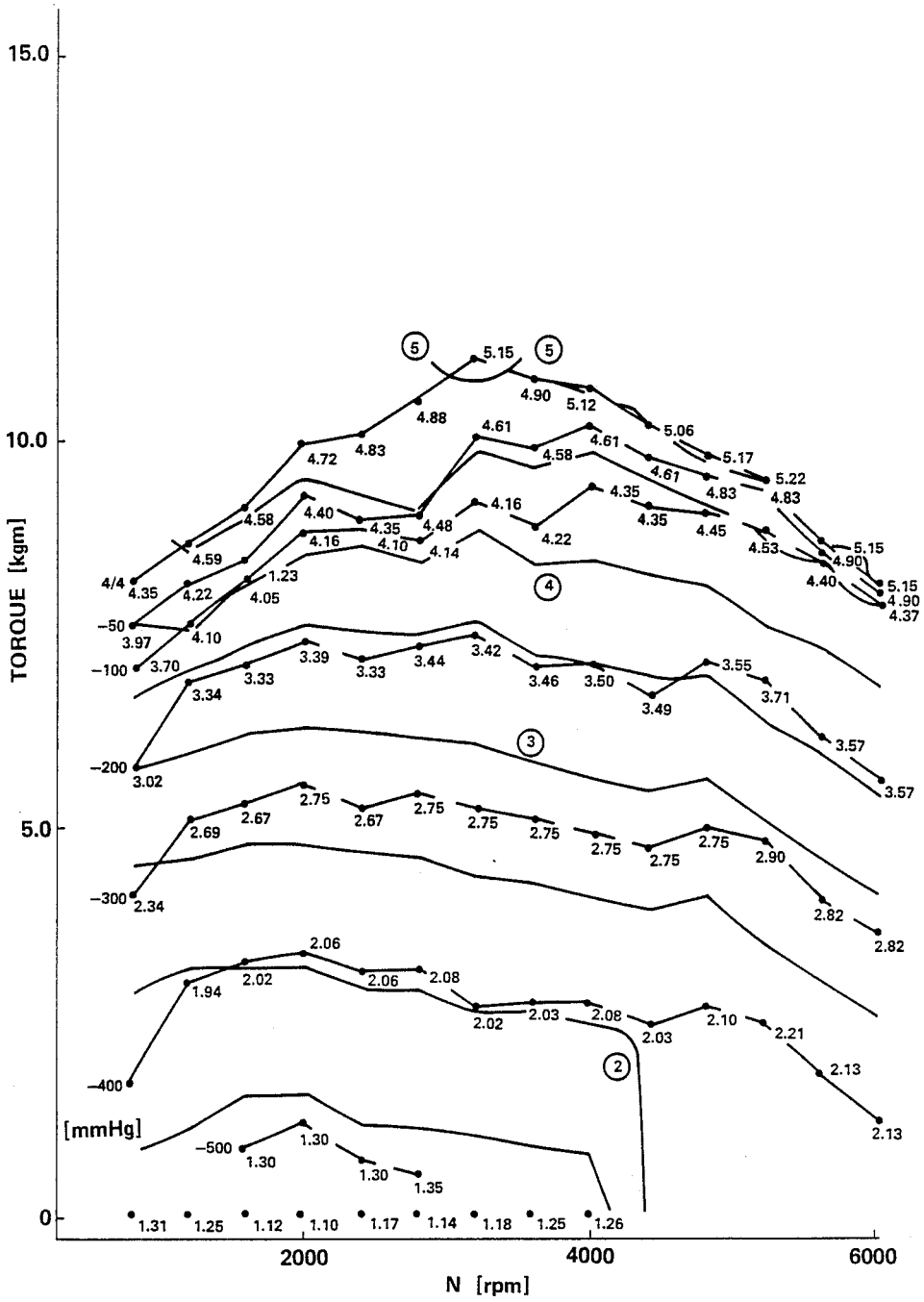
FIG. 13 is a graph showing experimentally obtained basic fuel injection amount.

As will be seen from FIGS. 11 and 12, in which FIG. 11 shows data obtained from experiments performed by the shown embodiment of the fuel supply control system, and FIG. 12 shows data obtained from experiments performed utilizing the conventional fuel supply control system which utilizes two-dimensional map for deriving the volumetric efficiency in terms of the engine speed and the intake air pressure. As seen from FIG. 11, since the volumetric efficiency generally varies in accordance with the intake air pressure at substantially the same engine speed because of lag in response of engine acceleration, error of the volumetric efficiency was while the intake air pressure varies from −400 mmHg to 4/4 mmHg at the engine speed 800 r.p.m. corresponds to 7% of $K_{FALT}$. On the other hand, in case of FIG. 12, the basic fuel injection pulse width varies from 1.71 ms at −400 mmHg to 4.35 ms at 4/4 mmHg to cause variation of 254% at the engine speed 800 r.p.m. Therefore, by utilizing the two-dimensional table as proposed in the conventional art, air/fuel ratio tends to fluctuate far from the target value as will be seen in FIG. 9.

According to the shown embodiment, since the basic fuel injection pulse width Tp is derived on the basis of the intake air pressure and the volumetric efficiency. The basic fuel injection pulse width precisely correspond to the engine demand as clearly seen from FIG. 13.

According to the present invention, since the altitude can be assumed based on the $K_{LRN}$ correction coefficient during hill-climbing and based on the pressure difference between the set intake air pressure and actual intake air pressure during down-hill driving, altitude can be assumed at any vehicular driving condition with sufficient precision. With satisfactorily high precision of the assumed altitude, the $K_{ALT}$ correction value can be precise enough to precise it set the induction volumetric efficiency.

Furthermore, since the shown embodiment of the fuel supply control system derives the basic fuel injection amount by multiplying the intake air pressure PB by the induction volumetric efficiency $Q_{CYL}$, modifying the product with intake air temperature dependent correction coefficient $K_{TA}$, and multiplying the modified product by the constant $K_{CON}$, the resultant value as the basic fuel injection amount can be satisfactorily precise.

It should be appreciate that the invention is applicable not only the specific construction of the fuel injection control systems but also for any other constructions of the fuel injection systems. For example, the invention may be applicable for the control systems set out in the co-pending U.S. patent application Ser. Nos. 171,022 and 197,843, respectively filed on March 18, 1988 and May 24, 1988, which have been assigned to the common assignee to the present invention. The disclosure of the above-identified two U.S. patent applications are herein incorporated by reference for the sake of disclosure.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention in the appended claims.

What is claimed is:

1. A fuel supply control system for an internal combustion engine, comprising:

means for supplying a controlled amount of fuel to an induction system of said internal combustion engine;

means for monitoring an engine driving condition including an engine speed and an intake air pressure;

means for deriving a basic volumetric efficiency on the basis of one of said engine speed and said intake air pressure;

means for deriving a correction value for said basic volumetric efficiency on the basis of said engine speed and said intake air pressure and modifying said basic volumetric efficiency with said correction value to derive a modified volumetric efficiency;

means for deriving a fuel supply amount on the basis of fuel supply control parameters monitored by said monitoring means and including said intake air pressure and said modified volumetric efficiency; and means for controlling said supplying means for adjusting amount of fuel to be supplied to said induction system to the derived value.

2. A fuel supply control system as set forth in claim 1, wherein said basic volumetric efficiency deriving means derives said basic volumetric efficiency on the basis of said intake air pressure.

3. A fuel supply control system as set forth in claim 1, wherein said basic volumetric efficiency deriving means operates at a frequency higher than or equal to that of said correction value deriving means.

4. A fuel supply control system as set forth in claim 1, which further comprises means for assuming an altitude on the basis of preselected engine driving condition indicative parameter monitored by said monitoring means.

5. A fuel supply control system as set forth in claim 4, wherein said altitude assuming means assumes the altitude on the basis of an engine speed dependent reference pressure and an actual intake air pressure measured by said monitoring means.

6. A fuel supply control system as set forth in claim 5, which further comprises means for deriving a correction value of the basis of assumed altitude for correcting said fuel supply amount.

7. A fuel supply control system as set forth in claim 1, wherein said monitoring means further monitors an intake air temperature, and which further comprise means for deriving a correction value on the basis of said intake air temperature for correcting said fuel supply amount.

8. A fuel supply control system as set forth in claim 1, wherein said monitoring means further monitors and oxygen concentration in an exhaust gas, and which system further comprises means for deriving a correction value on the basis of oxygen concentration so that the oxygen concentration in the exhaust gas is maintained in the vicinity of a predetermined value corresponding to a stoichometric value of an air/fuel ratio.

9. A fuel supply control system for an internal combustion engine, comprising:

fuel supply means for supplying a controlled amount of fuel to an induction system of said internal combustion engine;

monitoring means for monitoring an engine driving condition including an engine speed and an intake air pressure;

first means for deriving a first value representative of a basic volumetric efficiency on the basis said intake air pressure, said first means operating at a first frequency;

second means for deriving a correction value for said first value on the basis of said engine speed and said intake air pressure and modifying said first value with said correction value to derive a second value, said second means operating at a second frequency lower than said first frequency;

third means for deriving a basic fuel supply amount on the basis of said intake air pressure and said second value;

fourth means for deriving a correction value for said basic fuel supply amount on the basis of a correction parameter monitored by said monitoring means for deriving a control value for controlling said supply means; and fifth means for controlling said supply means for adjusting amount of fuel to be supplied to said induction system to the derived value.

10. A fuel supply control system as set forth in claim 9, which further comprises means for assuming an altitude on the basis of preselected engine driving condition indicative parameter monitored by said monitoring means.

11. A fuel supply control system as set forth in claim 10, wherein said altitude assuming means assumes the altitude on the basis of an engine speed dependent reference pressure and and actual intake air pressure measured by said monitoring means.

12. A fuel supply control system as set forth in claim 11, which further comprises means for deriving a correction value of the basis of assumed altitude for correcting said fuel supply amount.

13. A fuel supply control system as set forth in claim 9, wherein said monitoring means further monitors an intake air temperature, and which further comprise means for deriving a correction value on the basis of said intake air temperature for correcting said fuel supply amount.

14. A fuel supply control system as set forth in claim 9, wherein said monitoring means further monitors an oxygen concentration in an exhaust gas, and which system further comprises means for deriving a correction value on the basis of comprises means for deriving a correction value on the basis of oxygen concentration so that the oxygen concentration in the exhaust gas is maintained in the vicinity of a predetermined value corresponding to a stoichometric value of an air/fuel ratio.

* * * * *